US007155024B2

(12) United States Patent
Chang

(10) Patent No.: US 7,155,024 B2
(45) Date of Patent: Dec. 26, 2006

(54) MICROPHONE

(75) Inventor: Chao-Chih Chang, Taichung (TW)

(73) Assignee: Taiwan Carol Electronics Co., Ltd., Taichung (TW)

( * ) Notice: Subject to any disclaimer, the term of this patent is extended or adjusted under 35 U.S.C. 154(b) by 213 days.

(21) Appl. No.: 11/010,934

(22) Filed: Dec. 13, 2004

(65) Prior Publication Data

US 2006/0126880 A1 Jun. 15, 2006

(51) Int. Cl.
*H04R 25/00* (2006.01)

(52) U.S. Cl. ..... 381/362; 381/355

(58) Field of Classification Search ..... 381/362, 381/361, 359, 355

See application file for complete search history.

(56) References Cited

U.S. PATENT DOCUMENTS 3,642,558 A * 2/1972 Gorike ..... 381/355
4,065,648 A * 12/1977 Cvetko et al. ..... 381/359
5,144,677 A * 9/1992 Asakura et al. ..... 381/359
5,742,697 A * 4/1998 Ching-Chung ..... 381/361
6,463,159 B1 * 10/2002 Ming-Cheng ..... 381/359
6,968,070 B1 * 11/2005 Chiang ..... 381/361

* cited by examiner

*Primary Examiner*—Sinh Tran
(74) *Attorney, Agent, or Firm*—Frommer Lawrence & Haug LLP; Ronald R. Santucci

(57) ABSTRACT

A microphone includes a tubular housing extending along a longitudinal axis, a perforated cover mounted on a front open end of the housing and having a circular cross section along a plane transverse to the longitudinal axis, and a positioning ring sleeved on the perforated cover and having an outer peripheral surface that is formed alternately with a plurality of rolling sections and positioning sections. Each of the positioning sections has two opposite ends connected respectively to two adjacent ones of the rolling sections, and an intermediate part disposed between and indented relative to the opposite ends.

2 Claims, 6 Drawing Sheets

MICROPHONE

BACKGROUND OF THE INVENTION

1. Field of the Invention

The invention relates to a microphone, more particularly to a microphone that can be placed stably.

2. Description of the Related Art

Referring to FIGS. 1 and 2, a conventional microphone 1 is shown to include a tubular housing 11 extending along a longitudinal axis, a perforated cover 12 mounted on a front end of the housing 11 and having a circular cross section along a plane transverse to the longitudinal axis, and a positioning ring 13 sleeved on the perforated cover 12 for protection purposes and having an outer peripheral surface that is formed alternately with a plurality of rolling sections 132 and positioning facet sections 131. Each of the positioning facet sections 131 has two opposite ends 1311 connected respectively to two adjacent ones of the rolling sections 132, as shown in FIG. 2. Each positioning facet section 131 is flat, whereas each rolling section 132 is outwardly and radially convex relative to the longitudinal axis.

FIG. 3 illustrates a trace of the conventional microphone 1 when placed on a plane (L). When an external action force (F), which is composed of a horizontal component (F1) and a vertical component (F2), is applied to the conventional microphone 1, the gravity center (G) of the conventional microphone 1 tends to move along a path as indicated by an imaginary line (T). Under such a condition, a vertical reaction force (M) acts on the conventional microphone 1 as a result of the action force (F) while one of the positioning facet sections 131 contacts the plane (L). Since the horizontal component (F1) of the action force (F) results in continuous rolling of the conventional microphone 1, stable placement of the conventional microphone 1 on the plane (L) cannot be ensured.

SUMMARY OF THE INVENTION

Therefore, the object of the present invention is to provide a microphone that can be placed stably on a plane.

According to the present invention, a microphone comprises:

a tubular housing having a front open end and extending along a longitudinal axis;

a perforated cover mounted on the front open end of the housing and having a circular cross section along a plane transverse to the longitudinal axis; and a positioning ring sleeved on the perforated cover and having an outer peripheral surface that is formed alternately with a plurality of rolling sections and positioning sections, each of the positioning sections having two opposite ends connected respectively to two adjacent ones of the rolling sections, and an intermediate part disposed between and indented relative to the opposite ends.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
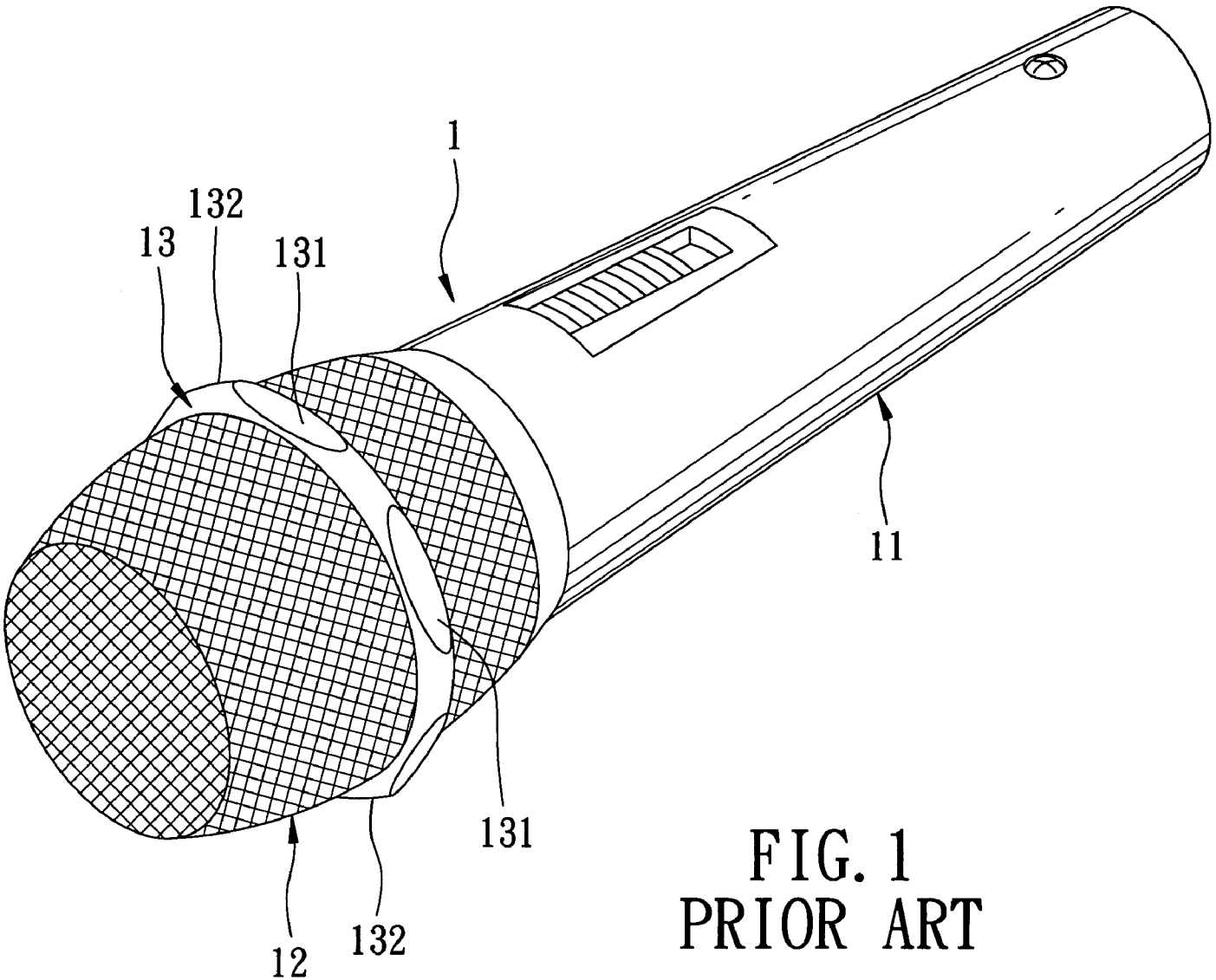
FIG. 1 PRIOR ART
FIG. 1 is a perspective view of a conventional microphone.
Figure 2:
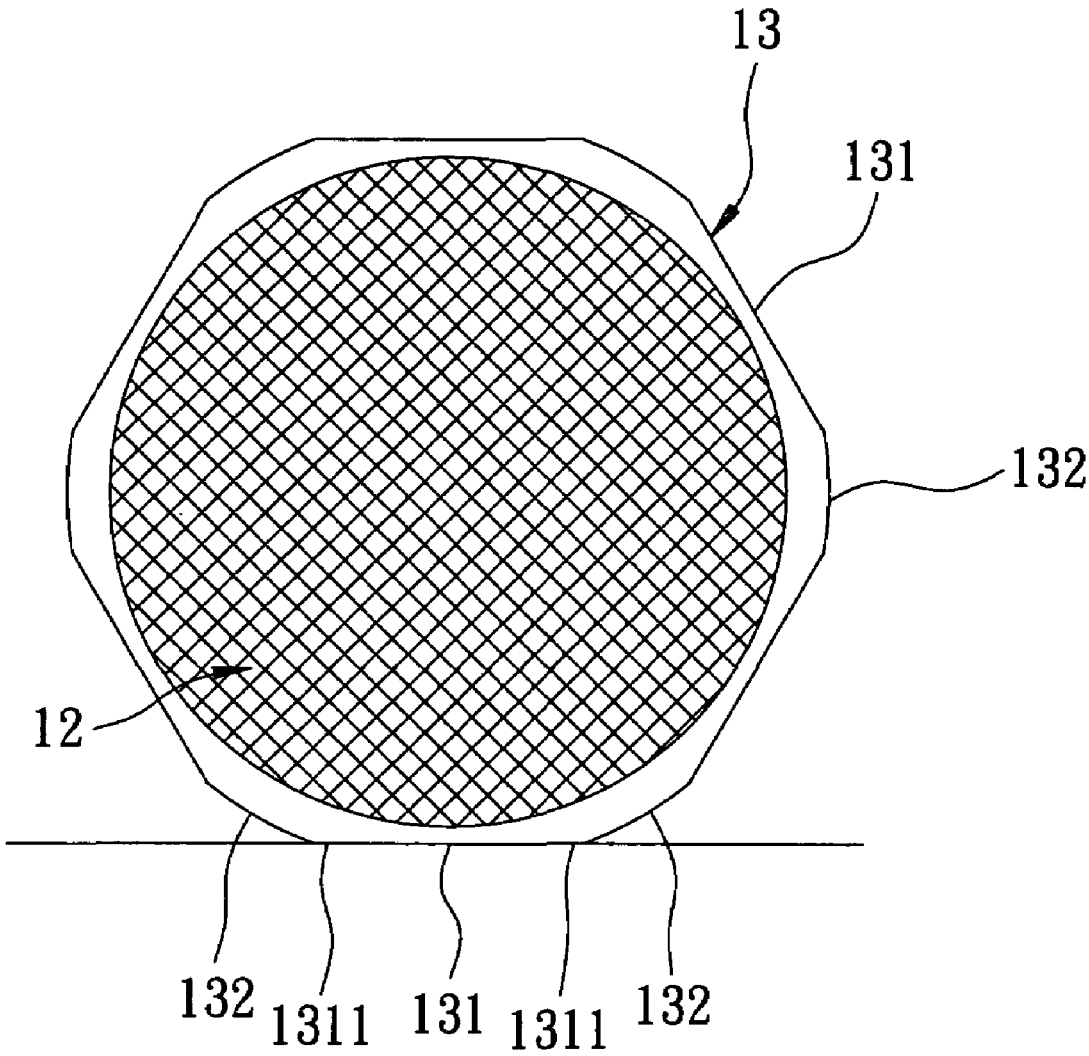
FIG. 2 PRIOR ART
FIG. 2 is a schematic front view of the conventional microphone.
Figure 3:
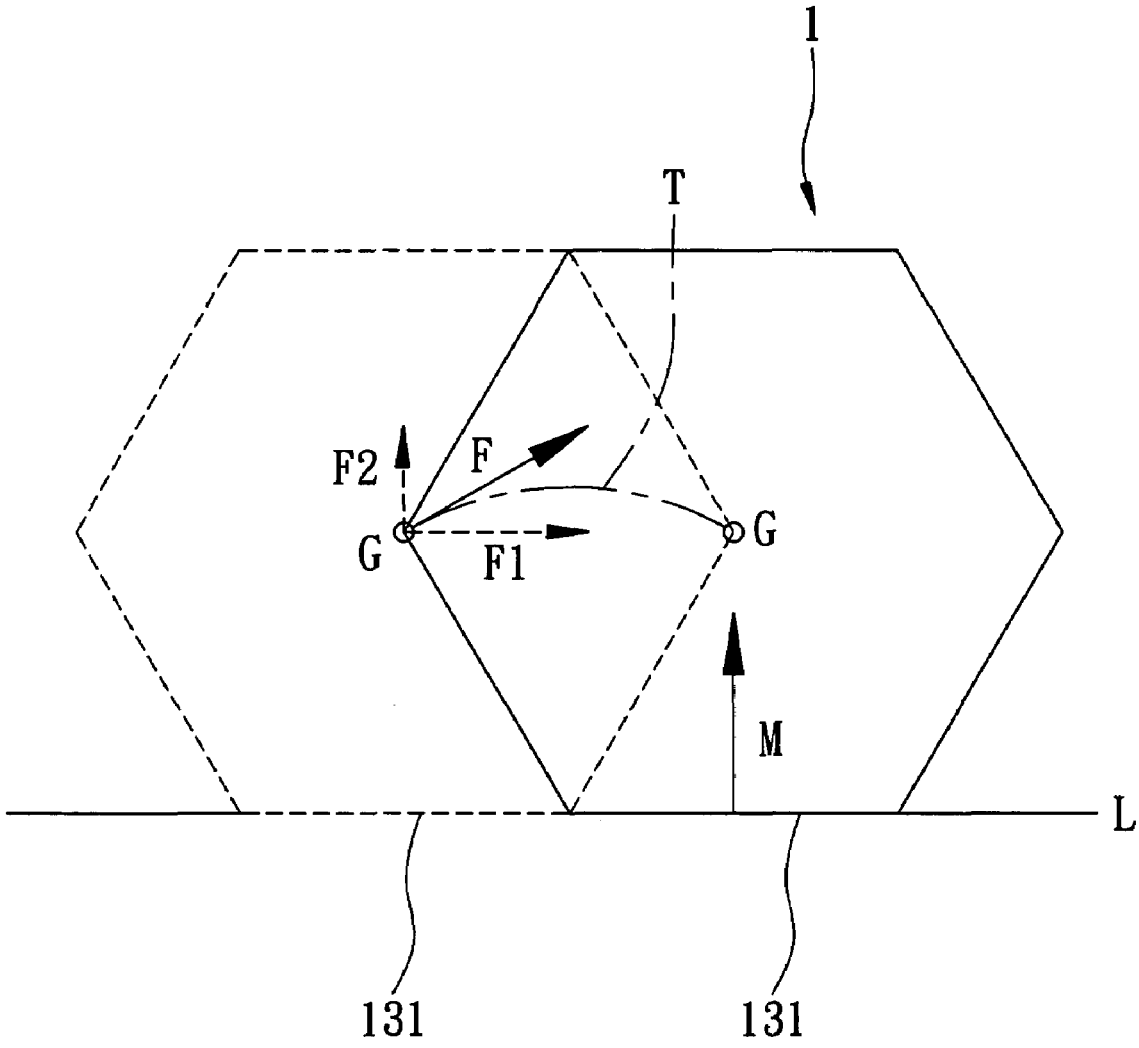
FIG. 3 PRIOR ART
FIG. 3 is a trace schematic view illustrating the conventional microphone when placed on a plane.
Figure 4:
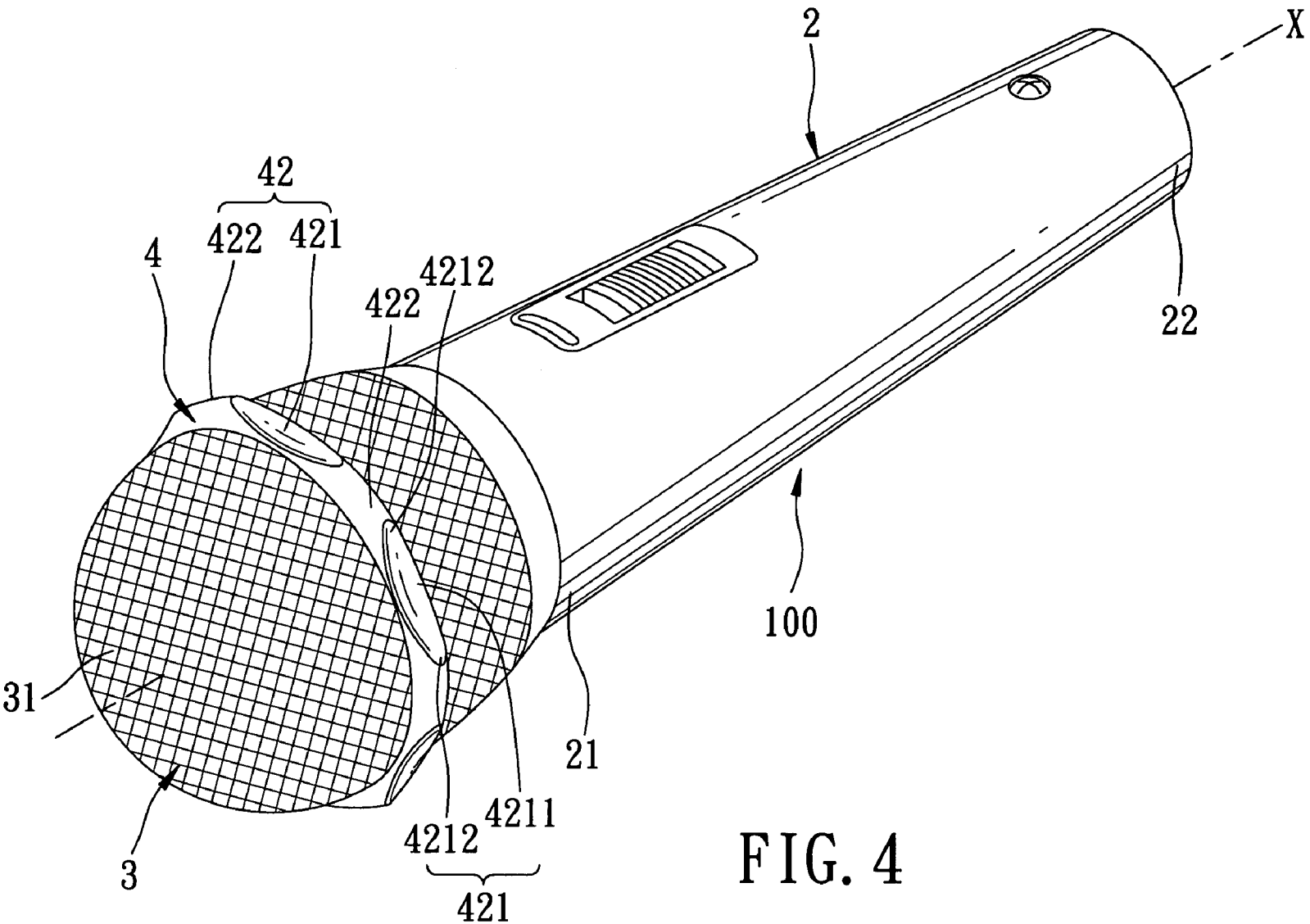
FIG. 4 is a perspective view showing the preferred embodiment of a microphone according to the present invention.

Referring to FIG. 4, the preferred embodiment of a microphone 100 according to the present invention is shown to include a tubular housing 2, a perforated cover 3, and a positioning ring 4.

The tubular housing 2 has a front open end 21 and a rear end 22, and extends along a longitudinal axis (X).

The perforated cover 3 is mounted on the front open end 21 of the housing 2, and has a circular cross section along a plane transverse to the longitudinal axis (X).

Figure 5:
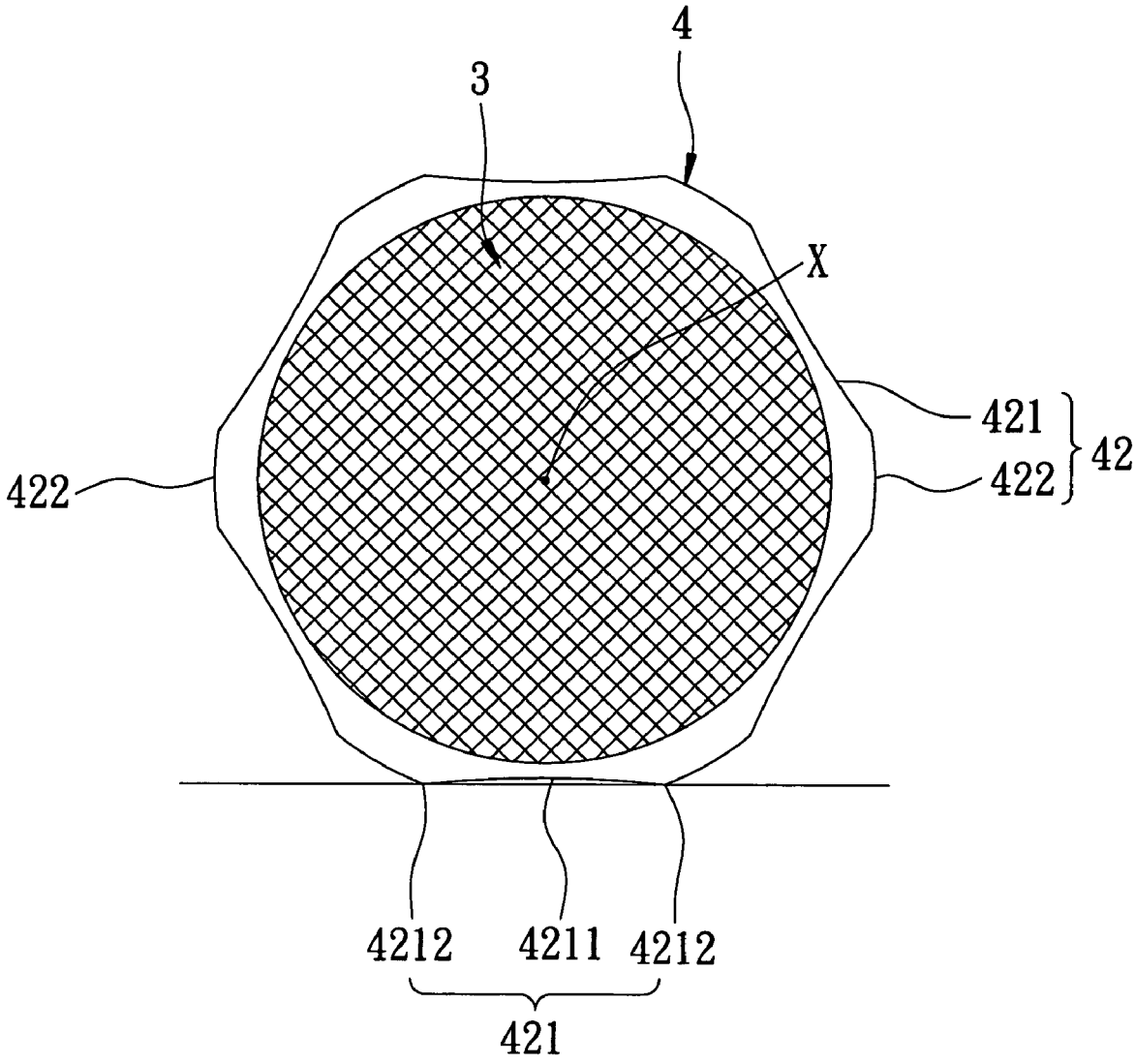
FIG. 5 is a schematic front view showing the preferred embodiment.

The positioning ring 4 is sleeved on the perforated cover 3 for protection purposes, and has an outer peripheral surface 42 that is formed alternately with a plurality of rolling sections 422 and positioning sections 421. Each of the positioning sections 421 has two opposite ends 4212 connected respectively to two adjacent ones of the rolling sections 422, and an intermediate part 4211 disposed between and indented relative to the opposite ends 4212, as shown in FIG. 4. In this embodiment, each of the rolling sections 422 is outwardly and radially convex relative to the longitudinal axis (X), and each of the positioning sections 421 is inwardly and radially concave relative to the longitudinal axis (X), as best shown in FIG. 5. It is noted that the positioning ring 4 may be connected integrally to the perforated cover 3 in other embodiments of this invention.

Figure 6:
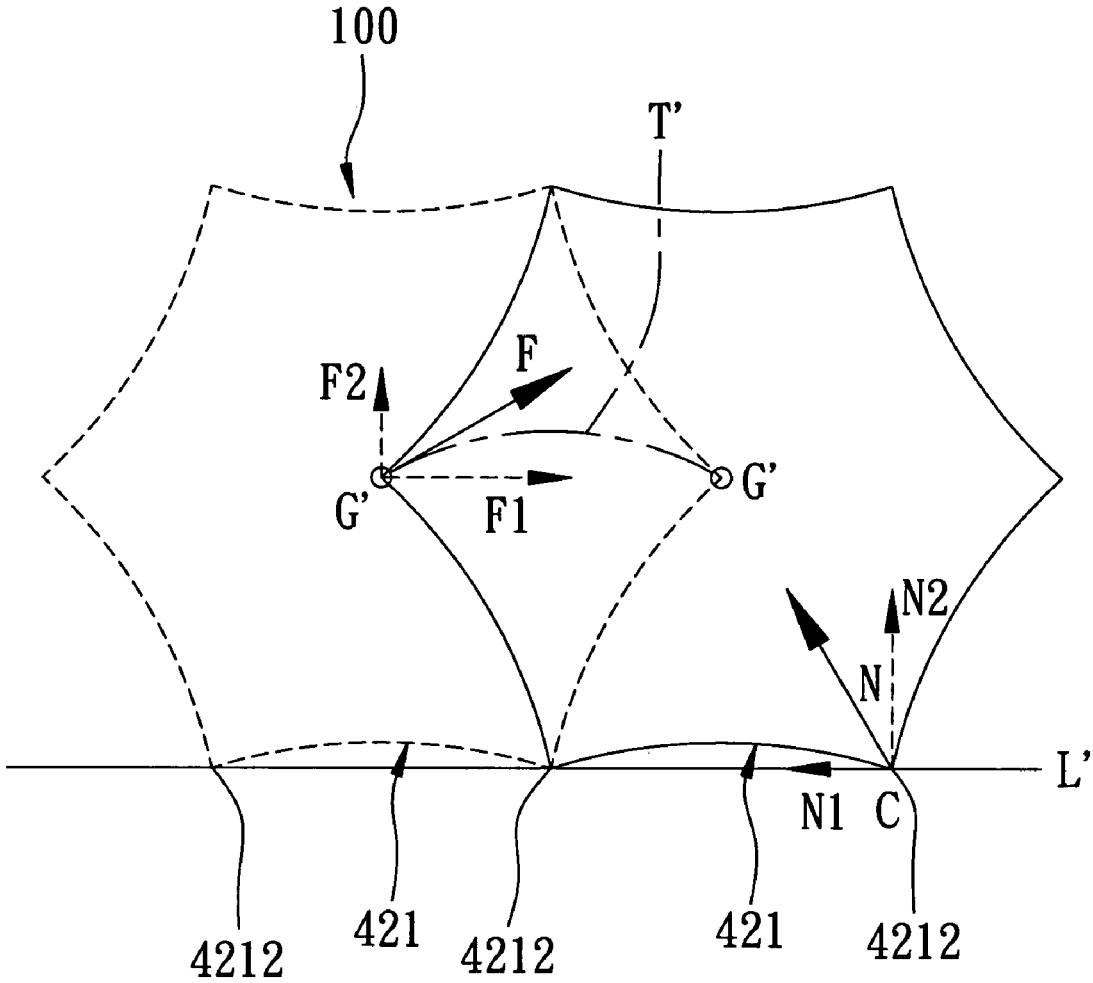
FIG. 6 is a trace schematic view illustrating the preferred embodiment when placed on a plane.

FIG. 6 illustrates a trace of the microphone 100 when placed on a plane (L'). When an external action force (F), which is composed of a horizontal component (F1) and a vertical component (F2), is applied to the microphone 100, the gravity center (G') of the microphone 100 tends to move along a path as indicated by an imaginary line (T'). Under such a condition, a reaction force (N), which is composed of a horizontal component (N1) and a vertical component (N2), acts on the microphone 100 as a result of the action force (F) while one end 4212 of one of the positioning sections 421, i.e., a point (c) shown in FIG. 6, contacts the plane (L'). Since the horizontal components (F1, N1) of the action and reaction forces (F, N) are counteracted by each other and since the weight of the microphone 100 is sufficient to overcome the vertical components (F2, N2) of the action and reaction forces (F, N), continuous rolling of the microphone 100 can be resisted such that the microphone 100 of this invention can be stably placed on the plane (L').

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A microphone comprising:

a tubular housing having a front open end and extending along a longitudinal axis;

a perforated cover mounted on said front open end of said housing and having a circular cross section along a plane transverse to the longitudinal axis; and a positioning ring sleeved on said perforated cover and having an outer peripheral surface that is formed alternately with a plurality of rolling sections and positioning sections, each of said positioning sections having two opposite ends connected respectively to two adjacent ones of said rolling sections, and an intermediate part disposed between and indented relative to said opposite ends.

2. The microphone as claimed in claim 1, wherein each of said rolling sections is outwardly and radially convex relative to the longitudinal axis, and each of said positioning sections is inwardly and radially concave relative to the longitudinal axis.

* * * * *